United States Patent [19]

Enami

[11] Patent Number: 4,996,864

[45] Date of Patent: Mar. 5, 1991

[54] DRAWING MACHINE

[75] Inventor: Toshiaki Enami, Osaka, Japan

[73] Assignee: Enami Seiki Mfg. Co., Ltd., Osaka, Japan

[21] Appl. No.: 455,971

[22] Filed: Dec. 22, 1989

[30] Foreign Application Priority Data

Dec. 29, 1988 [JP] Japan ..... 63-335109

[51] Int. Cl.[5] ..... B21D 24/00

[52] U.S. Cl. ..... 72/347; 72/397; 72/403

[58] Field of Search ..... 72/347, 348, 349, 381, 72/382, 396, 397, 403

[56] References Cited

U.S. PATENT DOCUMENTS

| | | | |
|---|---|---|---|
| 1,431,175 | 10/1922 | Ogden et al. | 72/347 |
| 2,318,819 | 5/1943 | Verson | 72/349 |
| 2,751,871 | 6/1956 | Higgins et al. | 72/396 |
| 4,036,056 | 7/1977 | Saunders | 72/347 |

FOREIGN PATENT DOCUMENTS

| | | |
|---|---|---|
| 3437123 | 4/1986 | Fed. Rep. of Germany . |
| 118810 | 3/1976 | German Democratic Rep. . |
| 550035 | 6/1974 | Switzerland . |

*Primary Examiner*—Lowell A. Larson

*Attorney, Agent, or Firm*—W. G. Fasse; D. H. Kane, Jr.

[57] ABSTRACT

A drawing machine for drawing a workpiece (41) comprises first and second drawing dies (42, 43), first and second push rods (45, 46, 47, 48) and first and second junction rods (53, 54). When the first push rods (45, 46) are downwardly moved, the first junction rod (53) is pressed and moved by the first push rod (45) to press the first drawing die (42). Consequently, the first drawing die (42) forms a first-stage drawn part in the workpiece (41). When the second push rods (47, 48) are downwardly moved, the second junction rod (54) is pressed and moved by the second push rod (48), to press the second drawing die (43). Consequently, the second drawing die (43) forms a second-stage drawn part in the workpiece (42). Thus, a plurality of stages of drawn parts can be formed by the same machine. A large number of holes (51, 52) may be provided in a junction die (55) for receiving junction rods (53), to insert the junction rods (53) in only prescribed ones of the holes. When the second drawing die (43) is changed in configuration or size, the positions of the junction rods (53) are also changed in response. Thus, jigs and tools can be efficiently exchanged in a short time in order to upper die with different patterns of drawing.

12 Claims, 11 Drawing Sheets

DRAWING MACHINE

BACKGROUND OF THE INVENTION

1. Field of the Invention

The present invention relates to a drawing machine for drawing a plate-type workpiece, which is supported by a lower die, into a prescribed configuration with a drawing die.

2. Description of the Background Art

FIG. 15 is a sectional view showing a ventilator cover 1, which is an example of a product drawn by a drawing machine. This ventilator cover 1 has three-stage drawn parts 2, 3 and 4, as well as an opening 5 provided in its center.

The ventilator cover 1 is drawn into a prescribed configuration from a metal plate 6 shown in FIG. 16A. In this case, various problems are caused if the three-stage drawn parts 2, 3 and 4 are simultaneously formed in a single drawing step. For example, the workpiece, i.e., the metal plate 6 may be broken or creased. Therefore, such a plurality of stages of drawn parts are generally formed in the plate-type workpiece one by one from the first-stage drawn part.

FIGS. 16B to 16E sequentially illustrate steps which are generally employed for manufacturing the ventilator cover 1. The metal plate 6 shown in FIG. 16A is first drawn with an upper die 7 and a lower die 8, as shown in FIG. 16B. The first-stage drawn part 2 is formed in this step. Both the upper die 7 and the lower die 8 have configurations corresponding to the first-stage drawn part 2. The upper die 7 has a shearing blade in its center for forming the opening 5 in the metal plate 6 simultaneously with the first-stage drawn part 2.

The workpiece thus provided with the first-stage drawn part 2 is transferred to another press, which has an upper die 9 and a lower die 10 as shown in FIG. 16C, so that the second-stage drawn part 3 is drawn therein.

Then the workpiece is transferred to still another press, which has an upper die 11 and a lower die 12 as shown in FIG. 16D, so that the third-stage drawn part 4 is drawn therein. Finally the workpiece is transferred to a further press which has an upper die 14 and a lower die 15. The upper die 14 has a shearing blade 13, which cuts/removes an edge portion 16 of the workpiece. Thus, the ventilator cover 1 is obtained in the prescribed configuration shown in FIG. 15.

In order to form a drawn part having a specific pattern in a plate-type workpiece, it has generally been necessary to prepare an upper die and a lower die in correspondence to the pattern. Therefore, absolutely different types of upper and lower dies are required for changing the pattern of the drawn part. In order to form a drawn part having a triangular plane configuration after forming a drawn part having a quadrangular plane configuration by the same press, for example, it is necessary to demount an upper die and a lower die for the drawn part having the quadrangular pattern from the body of the press and to newly mount an upper die and a lower die for the drawn part having the triangular pattern. Such operation is complicated and takes much time for exchanging jigs and tools.

In order to successively form a plurality of stages of drawn parts in the metal plate 6 as shown in FIGS. 16B to 16E, further, different presses are required for the respective stages of drawn parts. Therefore, four presses are required for forming four-stage drawn parts in the metal plate, for example. Thus, the cost for the overall manufacturing facility is increased while the area required for installing the manufacturing facility is also increased.

SUMMARY OF THE INVENTION

The present invention has been proposed to solve the aforementioned problems, and an object thereof is to provide a drawing machine which can efficiently exchange jigs and tools for drawing different patterns in a short time.

Another object of the present invention is to provide a drawing machine which can form a plurality of stages of drawn parts with the same machine.

These and other objects, features, aspects and advantages of the present invention will become more apparent from the following detailed description of the present invention when taken in conjunction with the accompanying drawings.

FIG. 1 is a sectional view illustrating the invention defined in claim 1. The drawing machine shown in FIG. 1 is adapted to draw a plate-type workpiece 21, which is supported by a lower die 20, into a prescribed configuration with a drawing lower die 22. The lower die 20 and the drawing die 22 are prepared in correspondence to the pattern of a prescribed drawing configuration.

The drawing machine further comprises an upper die 23, a plurality of push rods 24 to 29, drive means 30, a junction die 39 and junction rods 37 and 38.

The plurality of push rods 24 to 29 are respectively held by the upper die 23, to be movable along the pressing direction. The drive means 30 moves the push rods 24 to 29 toward the drawing die 22.

The junction die 39 is located between the upper die 23 and the drawing die 22. As shown in FIG. 1, this junction die 39 has holes 31 to 36 in positions corresponding to the push rods 24 to 29 respectively.

The junction rods 37 and 38 are movably held in prescribed holes 32 and 35, within the plurality of holes 31 to 36 which are provided in the junction die 39. One of the ends of the junction rods 37 and 38 can be brought into contact with prescribed push rods 25 and 28, while the other end thereof can be brought into contact with the drawing die 22. When the junction rods 37 and 38 are pressed and moved by the push rods 25 and 28, therefore, the drawing die 22 is also moved toward the lower die 20, as shown in FIG. 2.

FIG. 3 is a sectional view illustrating the invention defined in claim 4. The drawing machine shown in FIG. 3 is adapted to perform first-stage drawing and second-stage drawing on a plate-type workpiece 41, which is supported by a lower die 40, with a first drawing die 42 and a second drawing die 43 respectively.

This drawing machine further comprises an upper die 44, a plurality of first push rods 45 and 46, a plurality of second push rods 47 and 48, first drive means 49, second drive means 50, a junction die 55, a first junction rod 53, and a second junction rod 54.

The first push rods 45 and 46 are held by the upper die 44 to be movable along the pressing direction. The second push rods 47 and 48 are also held by the upper die 44 to be movable along the pressing direction, and paired with the first push rods 45 and 46 respectively. Referring to FIG. 3, the first push rod 45 is paired with the second push rod 47, while the other first push rod 46 is paired with the other second push rod 48.

The first drive means 49 moves the first push rods 45 and 46 toward the drawing dies 42 and 43. The second drive means 50 moves the second push rods 47 and 48 toward the drawing dies 42 and 43.

The junction die 55 is located between the upper die 44 and the first and second drawing dies 42 and 43, and provided with holes 51 and 52 in positions corresponding to the respective pairs of the first push rods 45 and 46 and the second push rods 47 and 48. Referring to FIG. 3, the hole 51 corresponds to the pair of first and second push rods 45 and 47, while the other hole 52 corresponds to the other pair of first and second push rods 46 and 48.

The first junction rod 53 is movably held in the hole 51, so that its first end can be brought into contact with the first push rod 45 and its second end can be brought into contact with the first drawing die 42. When the first junction rod 53 is pressed and moved by the second push rod 45, the first drawing die 42 is moved toward the lower die 40.

The second junction rod 54 is movably held in the other hole 52 of the junction die 55, so that its first end can be brought into contact with the second push rod 48 and its second end can be brought into contact with the second drawing die 43. When the second junction rod 54 is pressed and moved by the second push rod 48, the second drawing die 43 is pressed by the second junction rod 54 and moved toward the lower die 40.

With reference to FIGS. 1 and 2, the action/effect of the invention defined in claim 1 will now be described.

The drive means 30 moves all push rods 24 to 29 toward the drawing die 22. The junction rods 37 and 38 are inserted in only the prescribed holes 32 and 35, within the holes 31 to 36 which are provided in the junction die 39 in correspondence to the respective push rods 24 to 29. The push rods 25 and 28, which are located in the prescribed positions and moved toward the drawing die 22, are brought into contact with the junction rods 37 and 38, thereby moving the same toward the drawing die 22. The junction rods 37 and 38 are thus brought into contact with the drawing die 22 and move the same toward the lower die 20, thereby drawing the plate-type workpiece 21 in a desired pattern.

Consider the case of performing drawing in a pattern relatively smaller in diameter than the drawing pattern shown in the figures. In this case, another drawing die 22 and another lower die 20 are newly prepared in configurations corresponding to the drawing pattern which is relatively smaller in diameter. However, it is not necessary to replace the upper die 23, the push rods 24 to 29 and the junction die 39, but the positions of the junction rods 37 and 38 may simply be changed. In response to the pattern which is relatively smaller in diameter, for example, the junction rods 37 and 38 are extracted from the holes 32 and 35 and inserted in other prescribed holes 33 and 34. Thus, the junction rods 37 and 38 are pressed and moved by the push rods 26 and 27, which are located in other prescribed positions, to press the new drawing die 22, which is relatively reduced in diameter.

This also applies to the case of performing a drawing in a pattern which is relatively larger in diameter. That is, while the lower die 20 and the drawing die 22 must be replaced by those corresponding to the new prescribed pattern, it is not necessary to replace the upper die 23, the push rods 24 to 29 and the junction die 39 but the positions of the junction rods 37 and 38 may simply be changed.

According to the invention defined in claim 1, as hereinabove described, jigs and tools can be efficiently exchanged in a short time in order to provide an upper die with different drawings patterns.

With reference to FIGS. 3 to 5, the action/effect of the invention defined in claim 4 will now be described.

The first drive means 49 moves the first push rods 45 and 46 toward the first and second drawing dies 42 and 43, so that the first junction rod 53 is pressed/moved by the first push rod 45 to press the first drawing die 42. Consequently, the first drawing die 42 forms a first-stage drawn part in the plate-type workpiece 41. FIG. 4 shows this state.

Then, the second drive means 50 moves the second push rods 47 and 48 toward the first and second drawing dies 42 and 43, so that the second junction rod 54 is pressed/moved by the second push rod 48 to press the second drawing die 43. Thus, the second drawing die 43 forms a second-stage drawn part in the plate-type workpiece 41. FIG. 5 shows this state.

The first push rods 45 and 46 are simultaneously driven by the first drive means 49, while the second push rods 47 and 48 are simultaneously driven by the second drive means 50. That is, each pair of the first and second push rods 45 to 48 operates in the same manner. On the other hand, the first junction rod 53, which is held in the first hole 51 of the junction die 55, is different in configuration from the second junction rod 54, which is held in the second hole 52. For example, the first junction rod 53 is so formed as to be pressed/moved by the first push rod 45 but not pressed by the second push rod 47. On the other hand, the second junction rod 54 is so formed as to be pressed/moved by the first push rod 46 as well as by the second push rod 48, for example. Due to such difference in configuration, the movement stroke of the first junction rod 53 differs from that of the second junction rod 54.

Thus, according to the invention defined in claim 4, a plurality of stages of drawn parts can be formed by the same machine.

DESCRIPTION OF THE PREFERRED EMBODIMENTS

An embodiment of the present invention is now described with reference to a drawing machine for manufacturing a ventilator cover having a plurality of stages of drawn parts. FIGS. 6A to 6E are sectional views sequentially showing steps for manufacturing the ventilator cover, and FIGS. 7A to 7E are plan views corresponding to FIGS. 6A to 6E respectively. In this embodiment, the illustrated manufacturing steps are carried out in the same machine.

Before illustrating the machine, the manufacturing steps are now briefly described.

Figure 1:
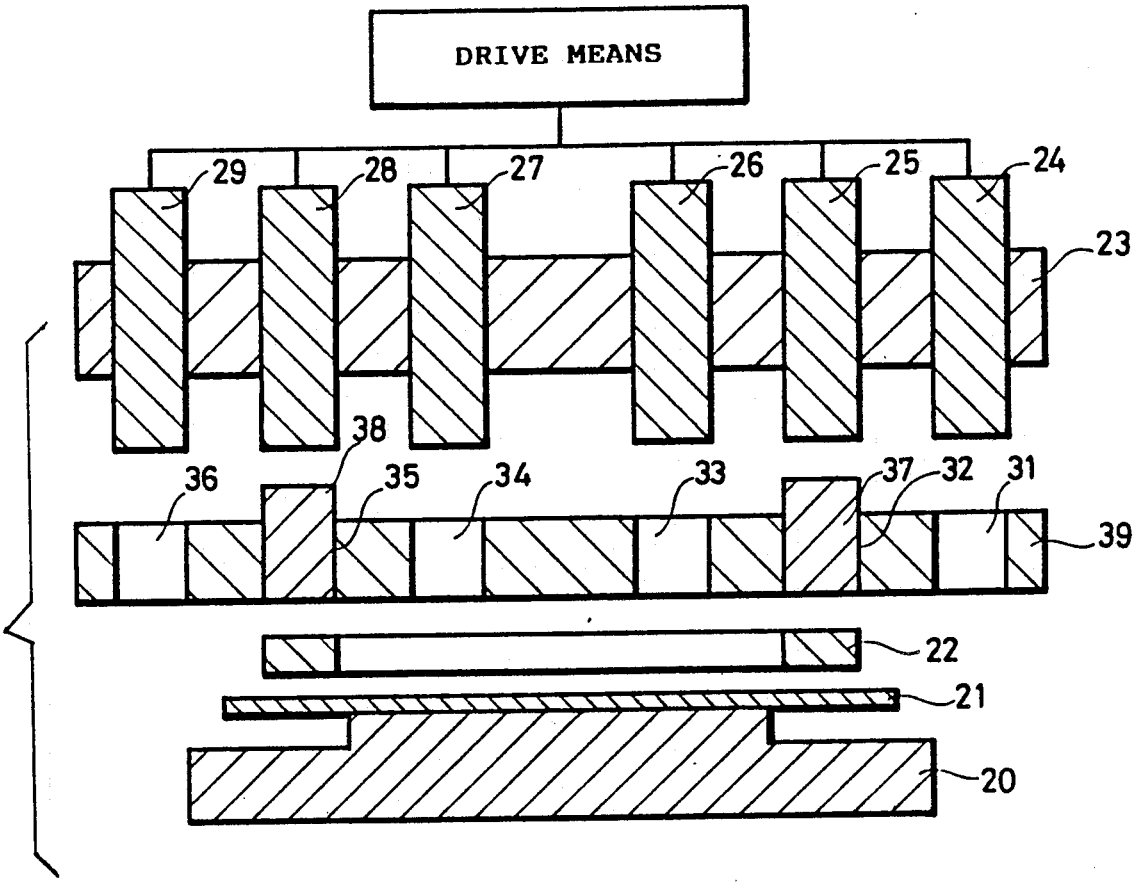
FIG. 1 illustrates a drawing machine corresponding to the invention defined in claim 1.
Figure 2:
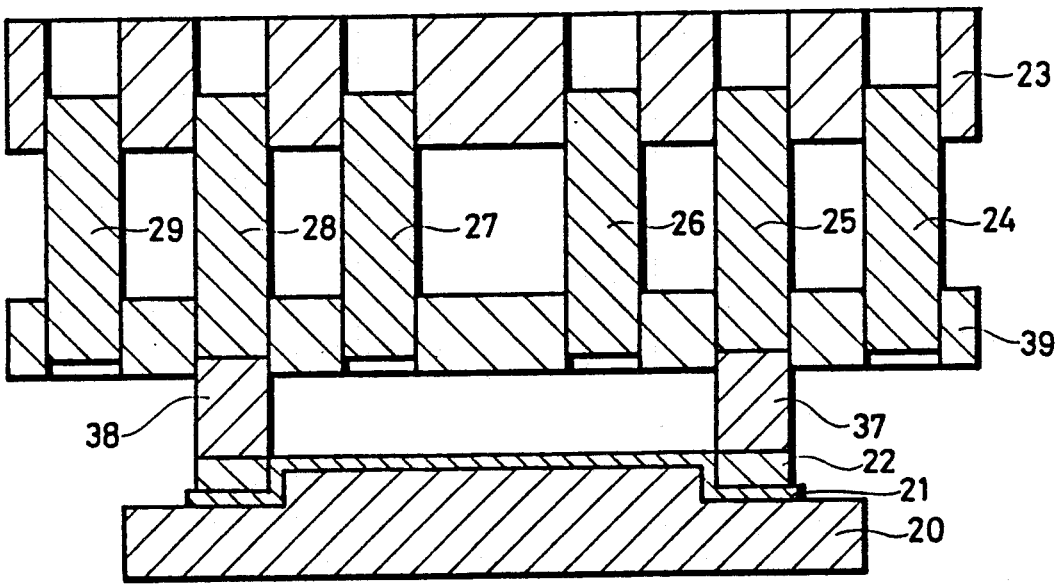
FIG. 2 illustrates the drawing machine shown in FIG. 1, which is in a state after operation.
Figure 3:
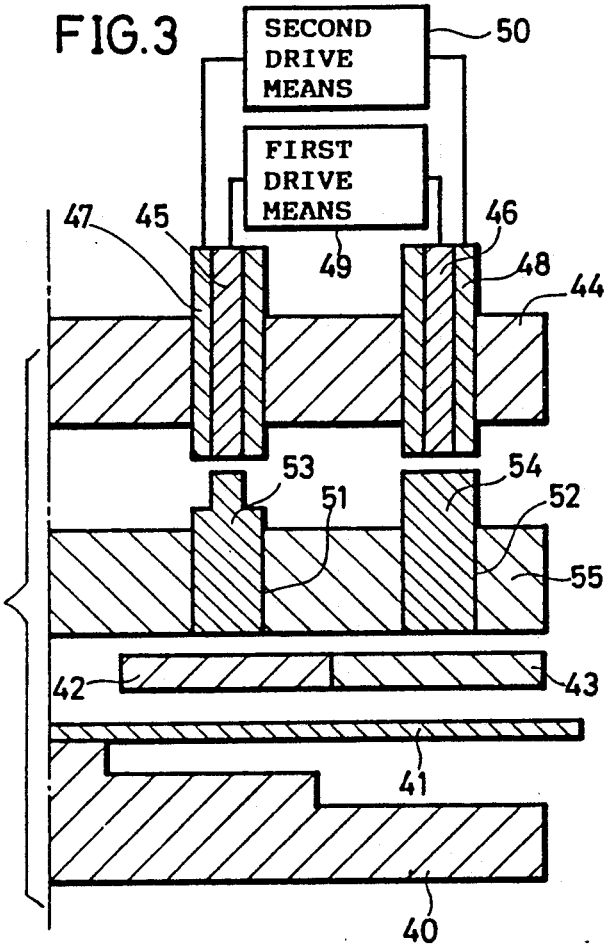
FIG. 3 illustrates a drawing machine corresponding to the invention defined in claim 4.
Figure 4:
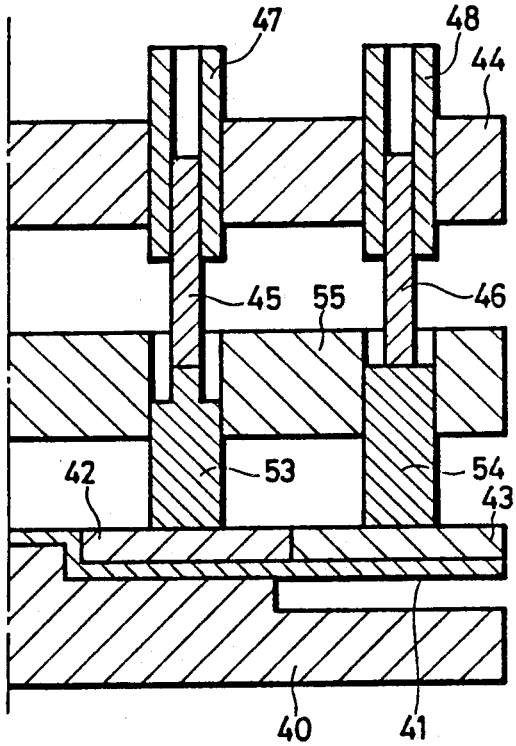
FIG. 4 illustrates the drawing machine shown in FIG. 3, which is in a state after performing first-stage drawing.
Figure 5:
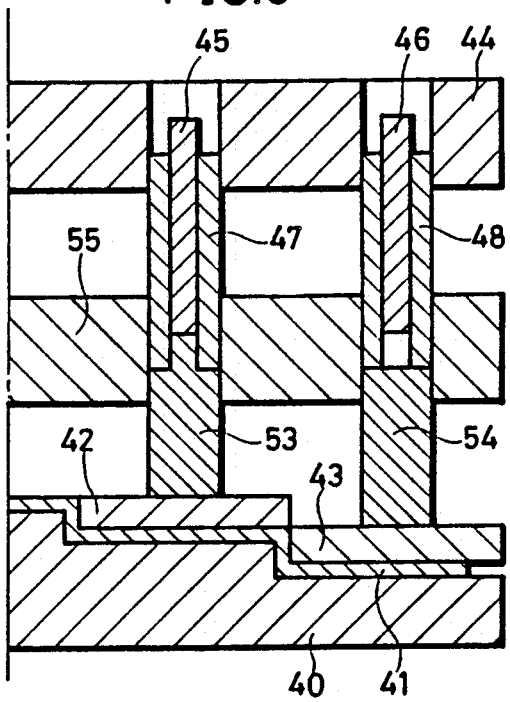
FIG. 5 illustrates the drawing machine in a state after forming a second-stage drawn part.
Figure 6A:
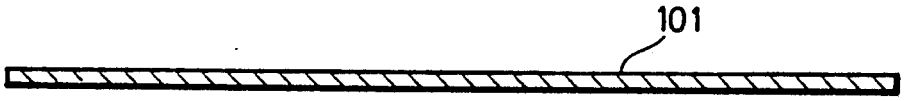
FIGS. 6A, 6B, 6C, 6D and 6E sequentially illustrate steps for manufacturing a product having three-stage drawn parts by drawing a flat metal plate.
Figure 6B:
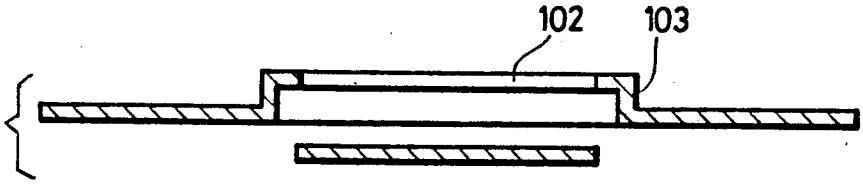
Figure 7A:
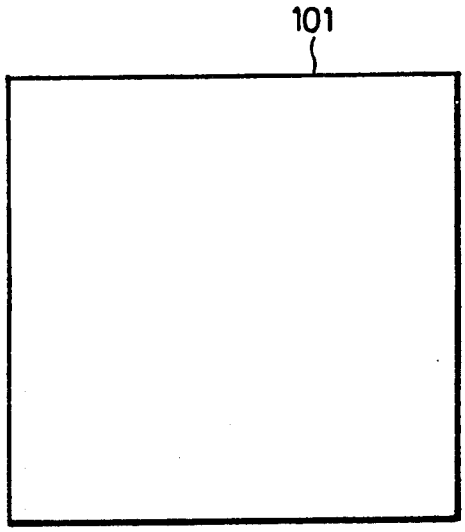
FIGS. 7A, 7B, 7C, 7D and 7E are plan views showing intermediate products corresponding to FIGS. 6A to 6E respectively.

First, a metal plate 101 having a quadrangular plane configuration is prepared as shown in FIGS. 6A and 7A. In the first manufacturing step shown in FIGS. 6B and 7B, a circular opening 102 is formed in the central portion of the metal plate 101 simultaneously with a first-stage drawn part 103. The drawn part 103 has a circular plane pattern.

Figure 6C:
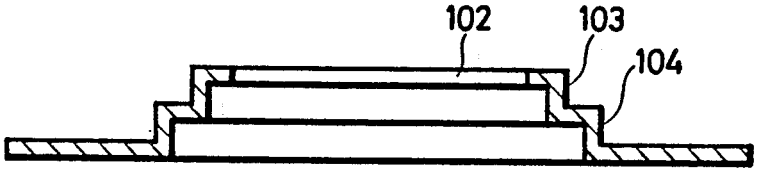
Figure 7D:
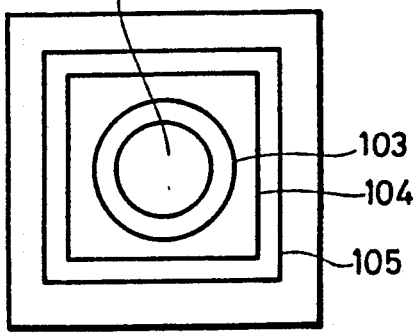
Figure 7B:
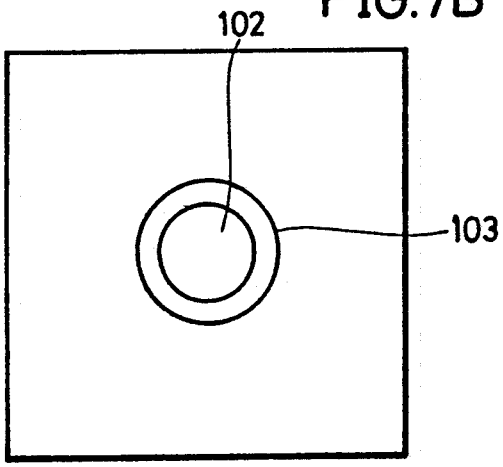
Figure 7E:
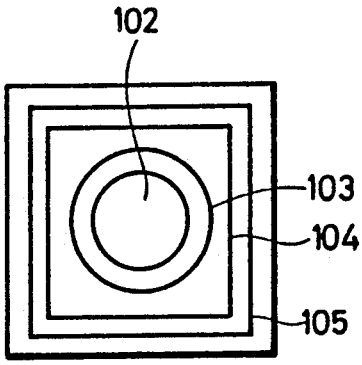
Figure 7C:
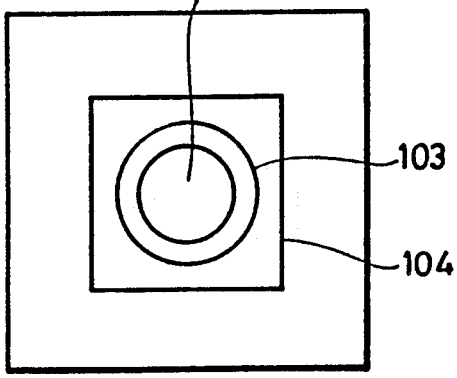

In the second manufacturing step, a second-stage drawn part 104 is formed as shown in FIGS. 6C and 7C. This drawn part 104 has a quadrangular plane pattern.

Figure 6D:
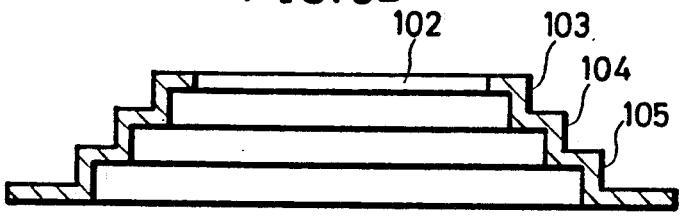

In the third manufacturing step, a third-stage drawn part 105 is formed as shown in FIGS. 6D and 7D. This drawn part 105 has a quadrangular plane pattern.

Figure 6E:
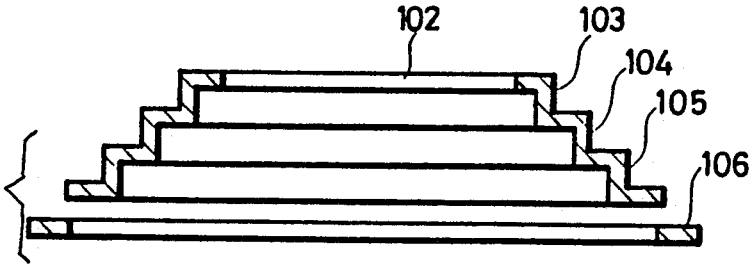

In the final (fourth) manufacturing step, an edge portion 106 is cut./removed as shown in FIGS. 6E and 7E.

Figure 8:
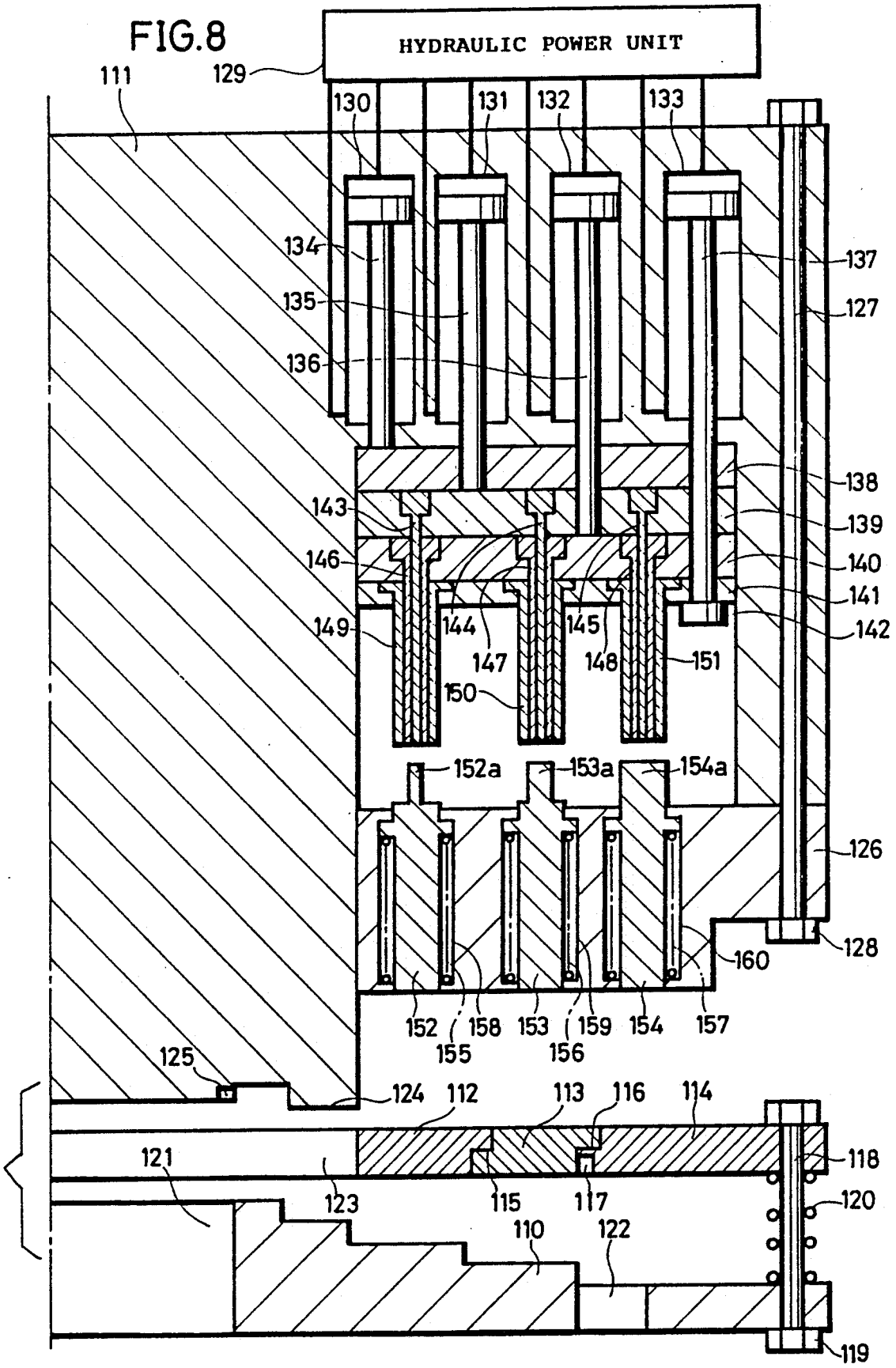
FIG. 8 is a sectional view showing a drawing machine according to another embodiment of the present invention.

FIG. 8 is a sectional view showing a drawing machine for carrying out the manufacturing steps shown in FIGS. 6A to 6E.

This drawing machine comprises a lower die 110 which is fixed to the machine body, and an upper die 111 which is held by the machine body in a vertically movable manner. The lower die 110 has a configuration corresponding to the final finished product shown in FIGS. 6E and 7E. As shown in FIG. 8, the lower die 110 is provided with an opening 121 in its central portion and with another opening 122 in its peripheral region. These openings 121 and 122 are adapted to discharge portions cut/removed from the metal plate 101 to the exterior.

The upper die 111 has a downwardly projecting central portion, which is provided on its forward end with a drawing part 124 for performing first-stage drawing on the metal plate 101. Further, a shearing blade 125 is mounted on the said forward end for forming the opening 102 (see FIG. 6B) in the metal plate 101.

A first drawing die 112, a second drawing die 113 and a cutter die 114 are arranged between the lower die 110 and the upper die 111. The first drawing die 112 has an opening 123 in its central portion. This opening 123 has a configuration which can receive the downwardly projecting central portion of the upper die 111. The second drawing die 113 is in contact with the periphery of the first drawing die 112, and defines a step 115 in the contact portion. Due to the presence of this step 115, the first drawing die 112 is supported by the second drawing die 113. The cutter die 114 is arranged in contact with the periphery of the second drawing die 113, and defines a step 116 in the contact portion. Due to the presence of this step 116, the second drawing die 113 is supported by the cutter die 114. As shown in FIG. 8, a shearing blade 117 is mounted on an inner edge portion of the cutter die 114, to cut/remove the edge portion 106 of the metal plate 101 in the final manufacturing step (see FIG. 6E).

A compression spring 120 is arranged between the cutter die 114 and the lower die 110, to upwardly urge the cutter die 114, as well as the second drawing die 113 and the first drawing die 112. A bolt 118 passes through the cutter die 114 and the lower die 110, and a nut 119 engages with the forward end of the bolt 118. The bolt 118 and the nut 119 define the maximum spacing between the cutter die 114 and the lower die 110.

The upper die 111 is provided with first to fourth hydraulic cylinders 130 to 133, which are driven by a hydraulic power unit 129. The first hydraulic cylinder 130 has a first piston rod 134 and the second hydraulic cylinder 131 has a second piston rod 135, while the third hydraulic cylinder 132 has a third piston rod 136 and the fourth hydraulic cylinder 133 has a fourth piston rod 137. The hydraulic power unit 129 has hydraulic pumps, electromagnetic directional control values and the like not shown), and drives the hydraulic cylinders 130 to 133 in desired order.

First to third movable plates 138 to 140 and a presser plate 141 are arranged to enclose the downwardly projecting central portion of the upper die 111. These plates 138 to 141 are vertically stacked as shown in FIG. 8. The presser plate 141 is fixed to/mounted on the third movable plate 140. The first to third movable plates 138 to 140 are vertically movable in FIG. 8 respectively.

The forward end portion of the first piston rod 134 provided in the first hydraulic cylinder 130 is in contact with the upper surface of the first movable plate 138. The forward end portion of the second piston rod 135 provided in the second hydraulic cylinder 131 is in contact with the upper surface of the second movable plate 139. The forward end portion of the third piston rod 136 provided in the third hydraulic cylinder 132 is in contact with the upper surface of the third movable plate 140. A support member 142 is mounted on the forward end portion of the fourth piston rod 137 provided in the fourth hydraulic cylinder 133, to support the presser plate 141.

The second movable plate 139 supports a plurality of first push rods 143 to 145. The first push rods 143 to 145 have head portions which are relatively increased in diameter, and shaft portions downwardly extending from the head portions. The head portions of the first push rods 143 to 145 are in contact with the lower surface of the first movable plate 138. Further, the shaft portions of the first push rods 143 to 145 extend through the second and third movable plates 139 and 140 and the presser plate 141.

The third movable plate 140 supports a plurality of second push rods 146 to 148. The second push rods 146 to 148 have head portions which are relatively increased in diameter, and shaft portions downwardly extending from the head portions. The shaft portions of the aforementioned first push rods 143 to 145 pass through the second push rods 146 to 148, which are in the form of cylinders. The head portions of the second push rods 146 to 148 are in contact with the lower surface of the second movable plate 139. Further, the shaft portions of the second push rods 146 to 148 downwardly extend through the third movable plate 140 and the presser plate 141.

The presser plate 141 supports a plurality of third push rods 149 to 151. The shaft portions of the aforementioned second push rods 146 to 148 pass through the third push rods 149 to 151, which are in the form of cylinders. Head portions of the third push rods 149 to 151 are in contact with the third movable plate 140, while shaft portions thereof downwardly project from the lower surface of the presser plate 141.

A junction die 126 is arranged in a position located under the first to third push rods 143 to 151. This junction die 126 is fixed to/mounted on the upper die 111 through a bolt 127 and a nut 128. The junction die 126 is provided with holes 158, 159 and 160 in positions corresponding to respective combinations of the first, second and third push rods 143 to 151.

A first junction rod 152 is received in the hole 158, which is closest to the downwardly projecting central portion of the upper die 111 within the plurality of holes 158, 159 and 160 provided in the junction die 126. A third junction rod 154 is received in the hole 160, which is most separated from the downwardly projecting central portion of the upper die 111. A second junction rod 153 is received in the intermediate hole 159. The first to third junction rods 152 to 154 are upwardly urged by springs 155 to 157 respectively. The first junction rod 152 has a head portion **152*a* which is identical in sectional configuration and size to the shaft portions of the first push rods 143 to 145. A head portion 153*a* of the second junction rod 153 has a sectional outline which is identical in configuration and size to those of the second push rods 146 to 148. A head portion 154*a* of the third junction rod 154 has a sectional outline which is identical in configuration and size to those of the third push rods 149 to 151**.

The operation of the drawing machine having the structure shown in FIG. 8 is now described.

Figure 9A:
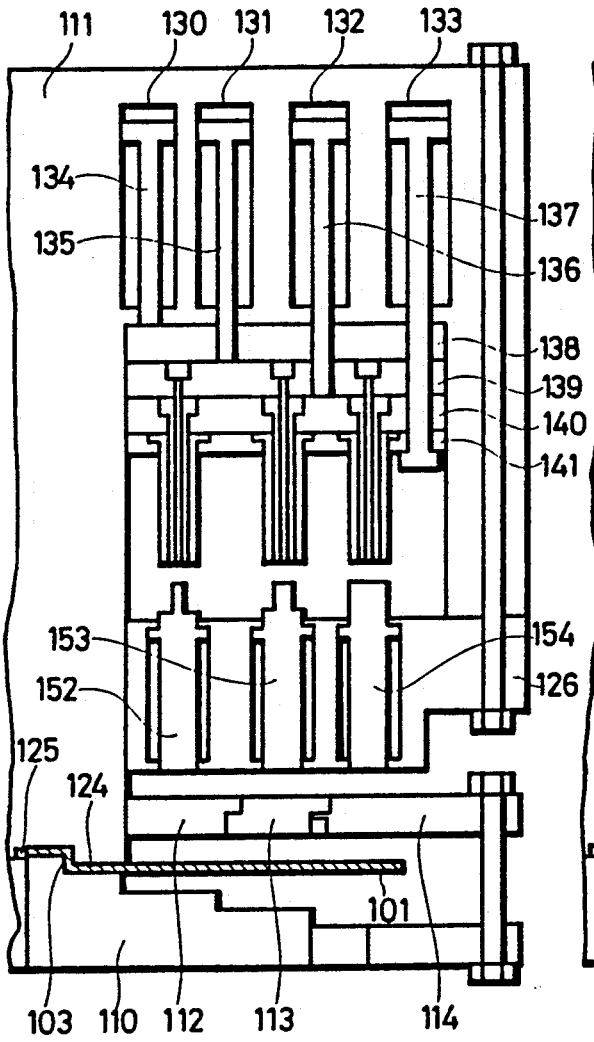
FIG. 9A is a sectional view showing the drawing machine of FIG. 8, which is in a state of forming a first-stage drawn part.

First, the metal plate 101 shown in FIG. 6A is placed on the lower die 110. Then, the upper die 111 is downwardly moved to carry out the step shown in FIG. 6B. FIG. 9A shows this state. The drawing portion 124 of the upper die 111 provides the first-stage drawn part 103 in the metal plate 101, while the shearing blade 125 forms the opening 120 in the central portion of the metal plate 101.

Figure 9B:
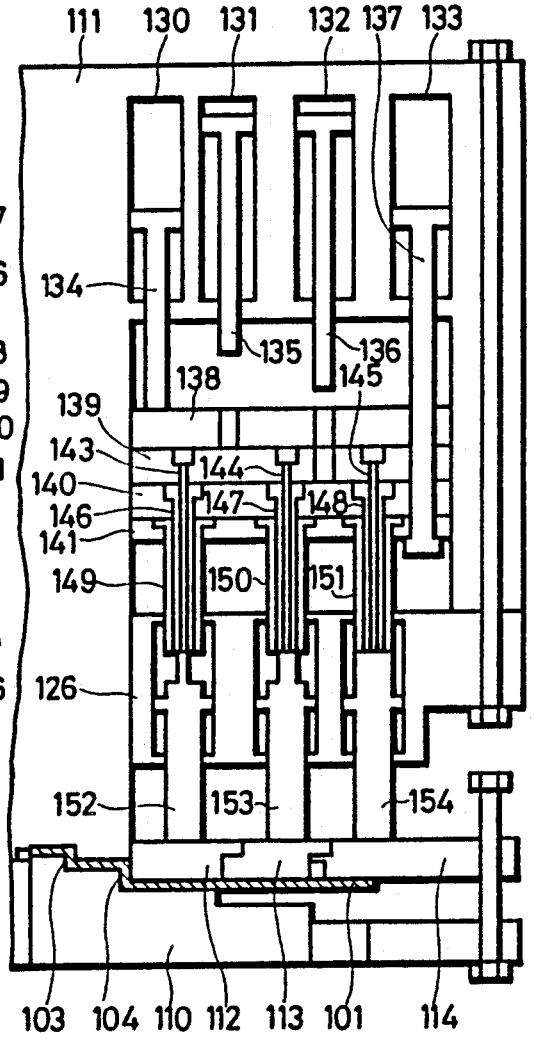
FIG. 9B is a sectional view of the drawing machine which is in a state of forming a second-stage drawn part.

Then, the hydraulic power unit 129 drives the first and fourth hydraulic cylinders 130 and 133, to carry out the step shown in FIG. 6C. FIG. 9B shows this state. The first piston rod 134 of the first hydraulic cylinder 130 presses/moves the first movable plate 138. Consequently, the first to third movable plates 138 to 140 and the presser plate 141 are downwardly moved. Thus, the first push rods 143 to 145, the second push rods 146 to 148 and the third push rods 149 to 151 are also downwardly moved. The shaft portion of the first push rod 143 is brought into contact with the head portion **152*a* of the first junction rod 152, to downwardly move the first junction rod 152. The shaft portion of the second push rod 147 is brought into contact with the head portion 153*a* of the second junction rod 153, to downwardly move the second junction rod 153. The shaft portion of the third push rod 151 is brought into contact with the head portion 154*a* of the third junction rod 154, to downwardly move the third junction rod 154. Thus, the first drawing die 112, the second drawing die 113 and the cutter die 114 are downwardly pressed/moved by the first to third junction rods 152 to 154 respectively, as shown in FIG. 9B. The first drawing die 112 forms the second-stage drawn part 104 in the metal plate 101**.

Figure 10A:
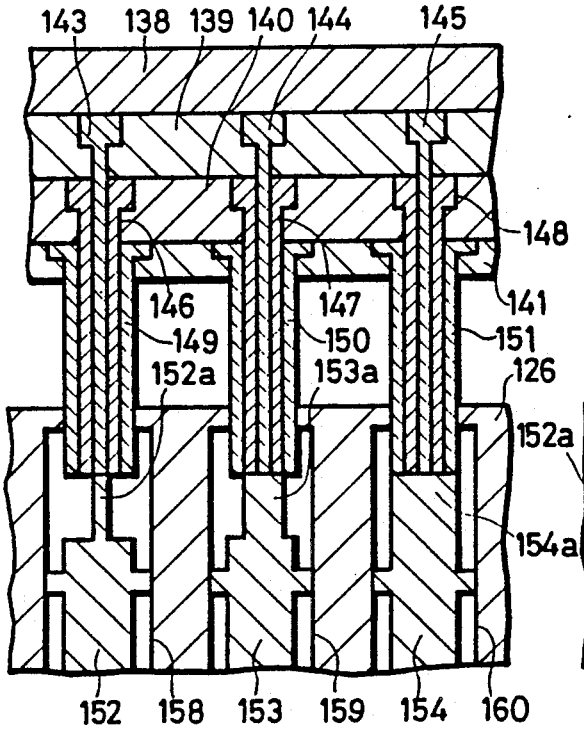
FIG. 10A is a partially enlarged sectional view corresponding to FIG. 9B.

FIG. 10A is an enlarged sectional view showing contact portions between the push rods 143 to 151 and the junction rods 152 to 154 in correspondence to the state shown in FIG. 9B. The first junction rod 152 is downwardly pressed/moved by the first push rod 143. The second junction rod 153 is downwardly pressed/-moved by both of the first and second push rods 144 and 147 in practice. The third junction rod 154 is downwardly pressed/moved by all of the first to third push rods 145, 148 and 151 in practice.

Figure 9C:
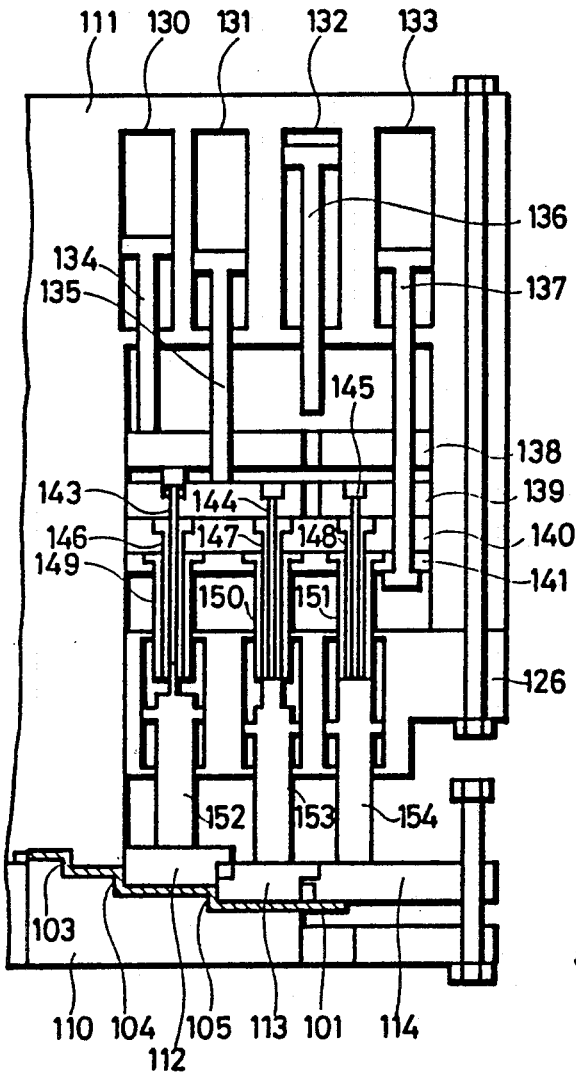
FIG. 9C is a sectional view of the drawing machine which is in a state of forming a third-stage drawn part.
Figure 10B:
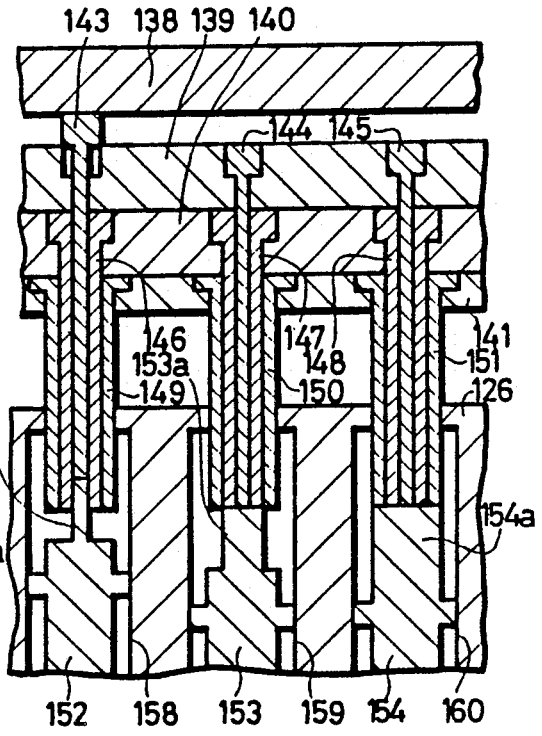
FIG. 10B is a partially enlarged sectional view corresponding to FIG. 9C.

Then, the hydraulic power unit 129 drives the second and fourth hydraulic cylinders 131 and 133 to carry out the step shown in FIG. 6D. FIG. 9C shows this state. The second piston rod 135 of the second hydraulic cylinder 131 is brought into contact with the second movable plate 139 to downwardly move the same. Consequently, the third movable plate 140 and the presser plate 141 are also downwardly moved. On the other hand, the first movable plate 138 remains in the state supported by the first junction rod 152 and the first push rod 143, and is prevented from downward movement. FIG. 10B shows a state corresponding to FIG. 9C.

Following the downward movement of the second and third movable plates 139 and 140, the second push rods 146 to 148 and the third push rods 149 to 151 are also downwardly moved. Consequently, the second junction rod 153 is downwardly pressed/moved by the second push rod 147, and the third junction rod 154 is downwardly pressed/moved by the second and third push rods 148 and 151, as understood from FIG. 10B. Since the first junction rod 152 cannot be further downwardly moved, the second and third push rods 146 and 149 are downwardly moved while receiving the head portion **152*a* of the second junction rod 152** therein.

As shown in FIG. 9C, the second junction rod 153 downwardly moves the second drawing die 113, and the third junction rod 154 downwardly moves the cutter die 114. Due to the downward movement of the second drawing die 113, the third-stage drawn part 105 is provided in the metal plate 101.

Figure 9D:
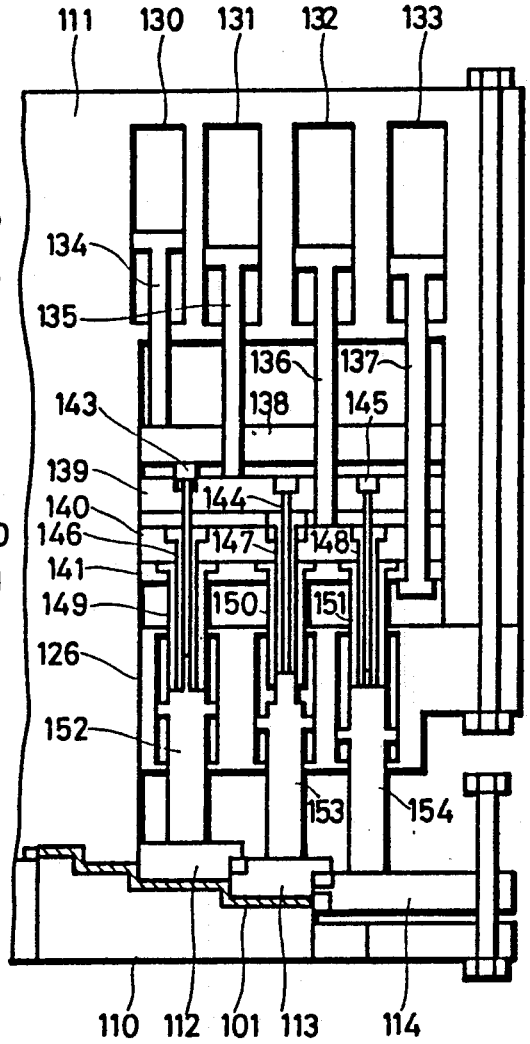
FIG. 9D is a sectional view of the drawing machine which is in a state of cutting/removing an edge portion of a plate-type workpiece.
Figure 10C:
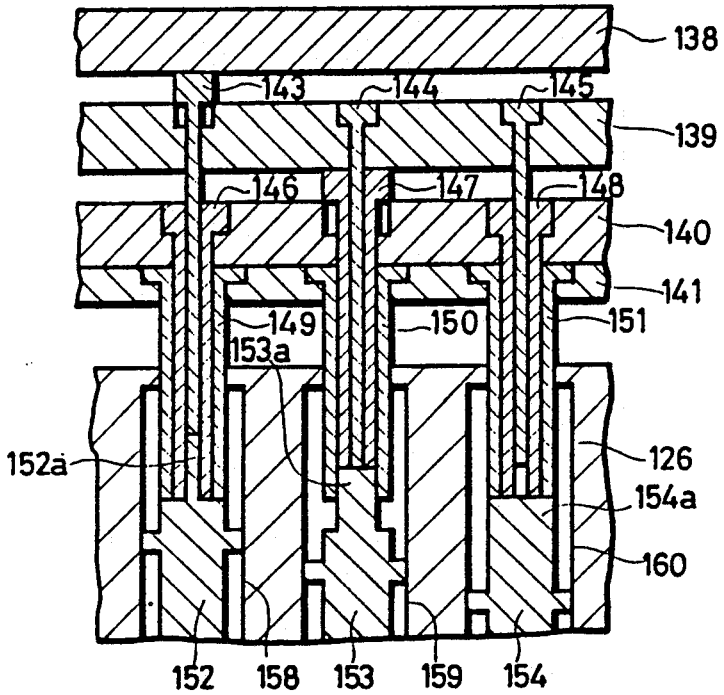
FIG. 10C is a partially enlarged sectional view corresponding to FIG. 9D.

Then, the third and fourth hydraulic cylinders 132 and 133 are driven to carry out the step shown in FIG. 6E, whereby the third and fourth piston rods 136 and 137 are downwardly moved. FIGS. 9D and 10C show this state. While the first and second movable plates 138 and 139 remain stationary, the third movable plate 140 and the presser plate 141 are downwardly pressed/-moved by the third piston rod 136. Consequently, the third push rods 149 to 151 are also downwardly moved. Thus, the third junction rod 154 is downwardly pressed/moved by the third push rod 151, to move the cutter die 114 toward the lower die 111. Due to such movement of the cutter die 114, the edge portion 106 of the metal plate 101 is cut/removed.

Since the first and second junction rods 152 and 153 remain stationary during the final cutting step as shown in FIG. 10C, the third push rods 149 and 150 are downwardly moved while receiving the head portions 152*a* and 153*a* of the first and second junction rods 152 and 153 therein respectively.

Finally the fourth piston rod 137 is upwardly moved. Consequently, the first to third movable plates 138 to 140 are also upwardly moved to return to the initial states. The first to third junction rods 152 to 154 are respectively urged by the springs 155 to 157 to return to the initial states Further, the first and second drawing dies 112 and 113 and the cutter die 114 are also urged by the spring 120 to return to the initial states.

As hereinabove described, the first push rods 143 to 145 are driven simultaneously with each other and the second push rods 146 to 148 are driven simultaneously with each other, while the third push rods 149 to 151 are driven simultaneously with each other in the drawing machine according to the present invention. On the other hand, the first junction rod 152 is downwardly pressed/moved by the first push rods, but not by the second and third push rods. The second junction rod 153 is downwardly pressed/moved by the first and second push rods, but not by the third push rods. The third junction rod 154 is downwardly pressed/moved by the first to third push rods. Consequently, movement strokes of the first to third junction rods 152 to 154 differ from each other. Through such differences of the movement strokes, the first drawing die 112, the second drawing die 113 and the cutter die 114 are sequentially moved to perform desired drawing.

Figure 11:
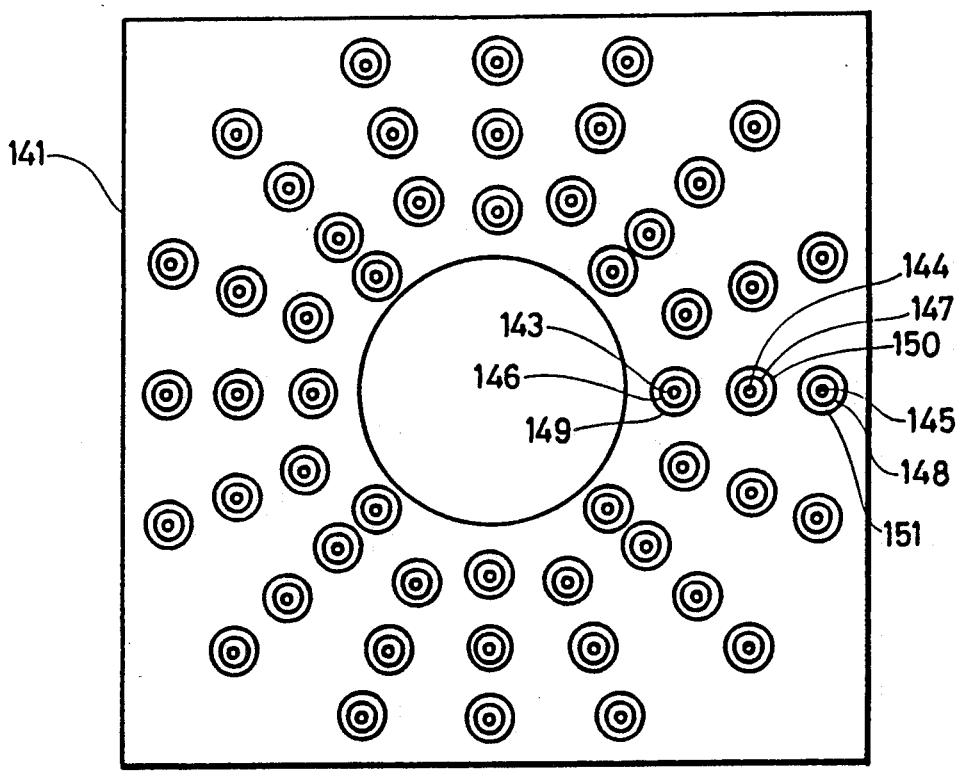
FIG. 11 is a bottom plan view of a presser plate 141 shown in FIG. 8.
Figure 12:
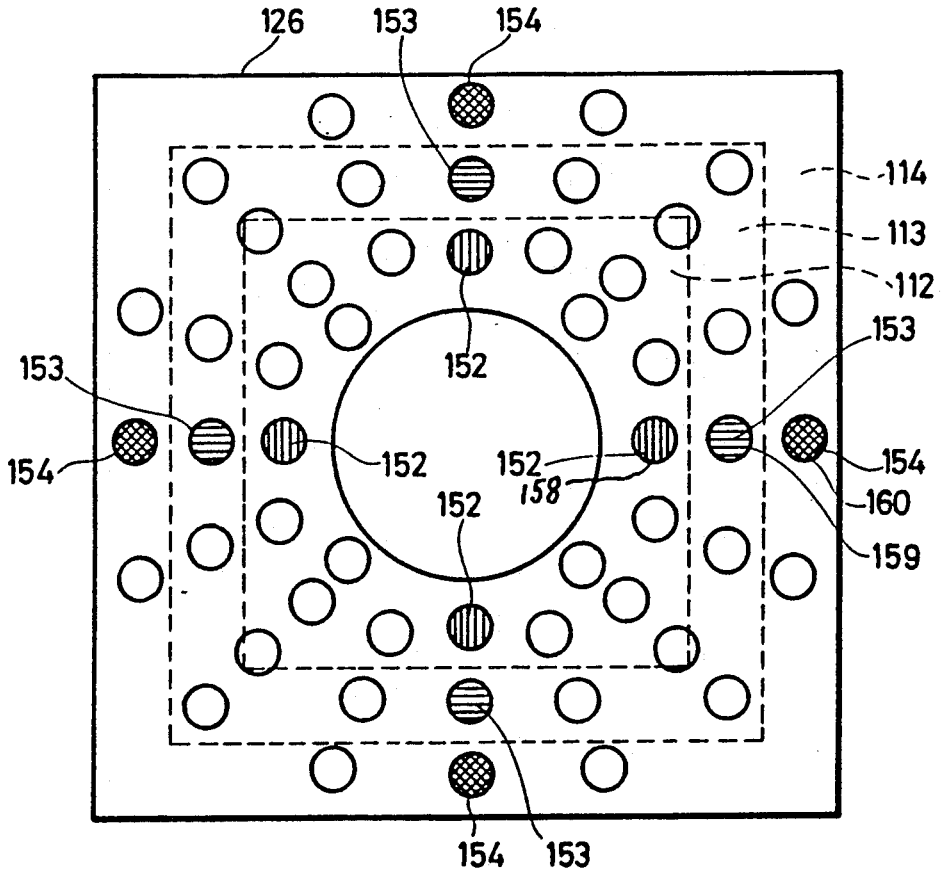
FIG. 12 is a top plan view of a junction die 126 shown in FIG. 8.

FIG. 11 is a bottom plan view of the presser plate 141, and FIG. 12 is a top plan view of the junction die 126. As shown in FIG. 11, large numbers of first to third push rods 143 to 151 project from the bottom surface of the presser plate 141. The first push rods 143 to 145 are identical in structure to each other, and simultaneously driven by the hydraulic power unit 129. The second and third push rods 146 to 151 are also identical in structure to each other and simultaneously driven by the hydraulic power unit 129. The first to third push rods 143 to 151 are combined in one-to-one correspondence respectively.

As shown in FIG. 12, the junction die 126 is provided with a large number of holes 158 to 160, which correspond to the aforementioned combinations of the first to third push rods 143 to 151. FIG. 12 also shows the configurations of the first and second drawing dies 112 and 113 and the cutter die 114 in dotted lines.

As shown in FIG. 12, not all the holes 158 to 160 provided in the junction die 126 receive the junction rods 152 to 154. In the shown example, four first junction rods 152 are received in prescribed holes 158 and four second junction rods 153 are received in prescribed holes 159, while four third junction rods 154 are received in prescribed holes 160. The remaining holes receive no junction rods. The four first junction rods 152 are received in the holes 158 which are located just above the first drawing die 112. The four second junction rods 153 are received in the holes 159 which are located just above the second drawing die 113, while the four third junction rods 154 are received in the holes 160 which are located just above the cutter die 114. The junction rods 152 to 154 are thus arranged to enable sequential movement of the first drawing die 112, the second drawing die 113 and the cutter die 114.

Figure 13:
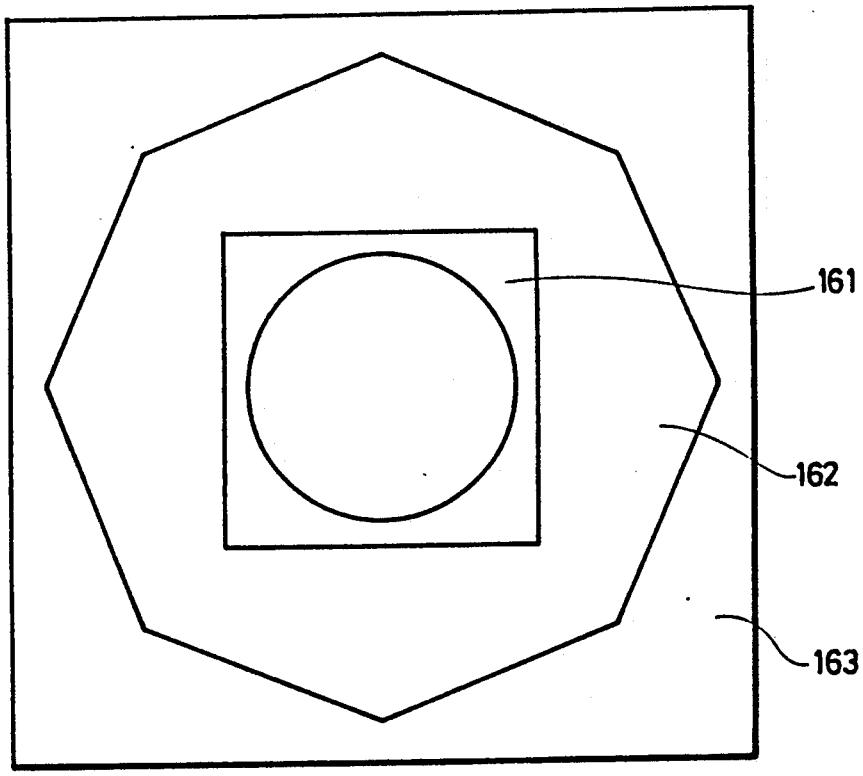
FIG. 13 is a plan view showing drawing dies for forming different patterns of drawn parts.

According to the inventive drawing machine, jigs and tools can be efficiently exchanged in a short time in order to upper die with different patterns of drawing. Consider the case of performing three-stage drawing through a plurality of drawing dies 161 to 163 shown in FIG. 13, for example. Referring to FIG. 13, the first drawing die 161 is adapted to form a drawn part having a circular plane pattern and the second drawing die 162 is adapted to form a drawn part having a quadrangular plane pattern, while the third drawing die 163 is adapted to form a drawn part having a regular octagonal plane pattern. In order to change the patterns of the drawn parts shown in FIG. 7E to those of the drawn parts shown in FIG. 13, the first and second drawing dies 112 and 113 and the cutter die 114 shown in FIG. 8 are replaced by the first to third drawing dies 161 to 163 shown in FIG. 13. The lower die 110 is also replaced by that having a configuration corresponding to the prescribed patterns. On the other hand, it is not particularly necessary to replace the upper die 111 and the members mounted on the upper die 111, but arrangement of the junction rods 152 to 154 may simply be changed.

Figure 14:
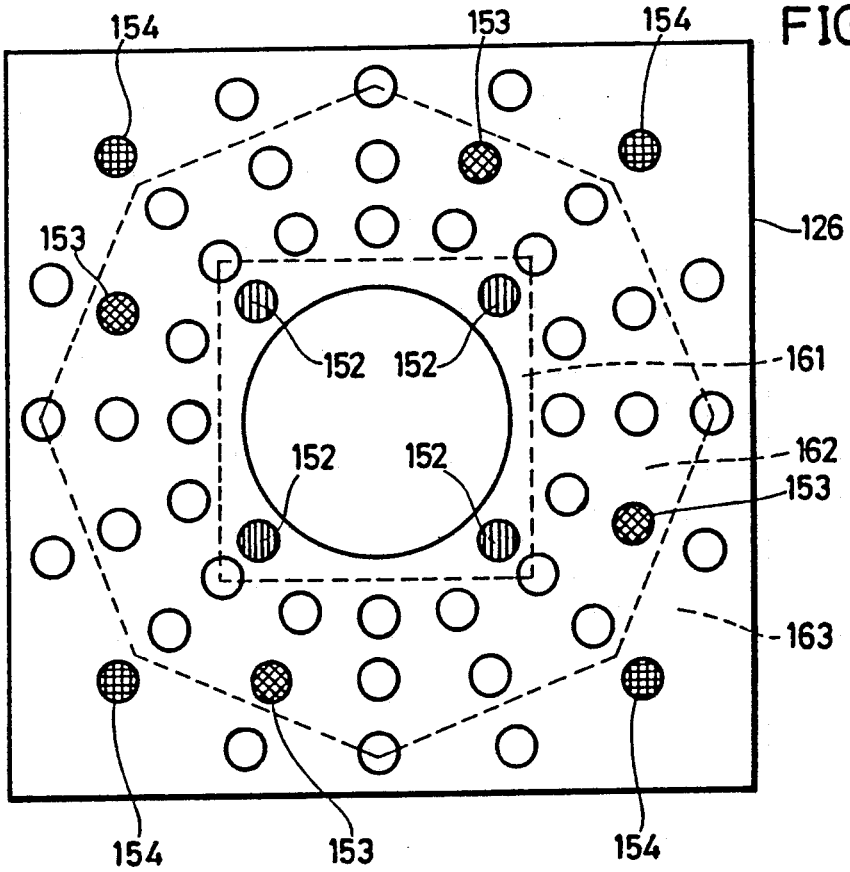
FIG. 14 is a top plan view showing the junction die 126, in which the arrangement modes of junction rods are changed in correspondence to the drawing dies shown in FIG. 13.
Figure 15:
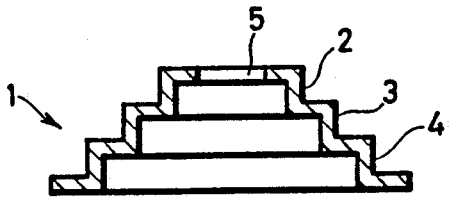
FIG. 15 is a sectional view showing a ventilator cover, which is an exemplary product drawn in a multi-stage manner.
Figure 16A:
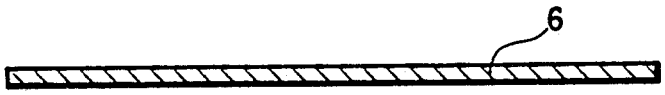
FIGS. 16A, 16B, 16C, 16D and 16E sequentially illustrate conventional manufacturing steps for obtaining the product shown in FIG. 15.
Figure 16B:
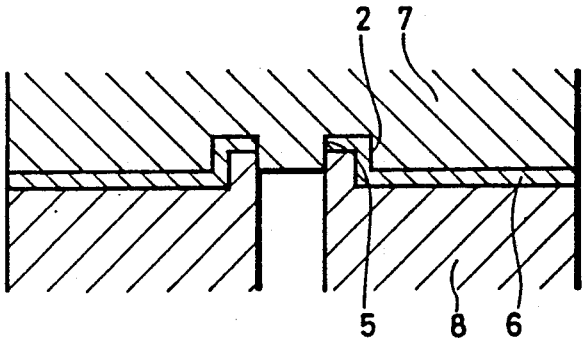
Figure 16D:
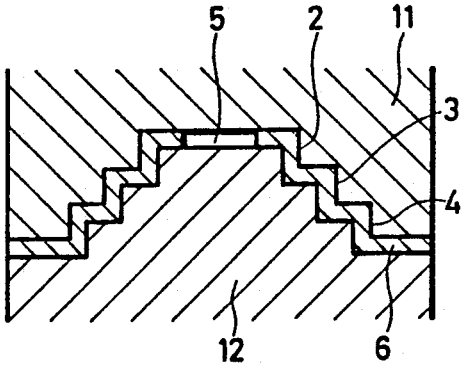
Figure 16C:
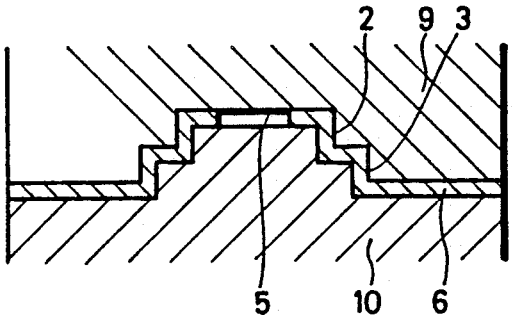
Figure 16E:
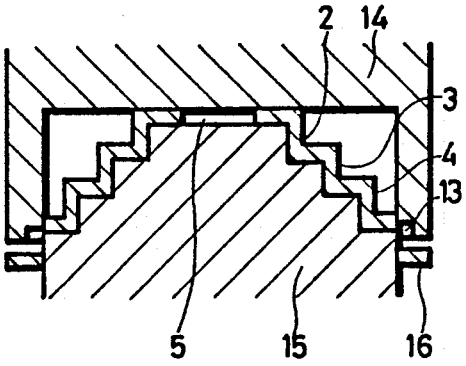

FIG. 14 is a top plan view showing the junction die 126, in which the arrangement modes of the junction rods 152 to 154 are changed. As shown in FIG. 14, four first junction rods 152 are received in holes which are located just above the first drawing die 161 and four second junction rods 153 are received in holes which are located just above the second drawing die 162, while four third junction rods 154 are received in holes which are located just above the third drawing die 163.

In order to perform drawing with the drawing dies 161 to 163 shown in FIG. 13, operation similar to that of the aforementioned embodiment is performed. Thus, the jigs and tools can be efficiently exchanged in a short time according to the inventive drawing machine. While the above embodiment has been described with reference to a drawing machine for multi-stage drawing, the effect of the present invention can also be attained in a drawing machine for single-stage drawing.

Although the present invention has been described with reference to FIGS. 1 to 14, the examples shown in the drawings are merely illustrative of an embodiment of the present invention. Therefore, various corrections and modifications are available within the scope of the present invention. For example, although the hydraulic power unit and hydraulic cylinders are employed as drive means for driving the push rods in the aforementioned embodiment, other drive sources are also employable, as a matter of course. Further, the terms "upper die" and "lower die" are not particularly intended to specify vertical positional relation therebetween. The vertical positions of the upper die and the lower die may be inverted, for example.

Although the present invention has been described an illustrated in detail, it is clearly understood that the same is by way of illustration and example only and is not to be taken by way of limitation, the spirit and scope of the present invention being limited only by the terms of the appended claims.

What is claimed is:

1. A drawing machine for drawing a plate-type workpiece (21) supported by a lower die (20) into a prescribed configuration with a drawing die (22), said drawing machine comprising:

an upper die (23);

a plurality of push rods (24, 25, 26, 27, 28, 29) held by said upper die to be movable along the pressing direction;

drive means (30) for moving said push rods toward said drawing die;

a junction die (39) located between said upper die and said drawing tie and provided with holes in positions corresponding to respective said push rods; and junction rods (37, 38) movably held in prescribed ones of said plurality of holes provided in said junction die so that first ends thereof can be brought into contact with said push rods and second ends thereof can be brought into contact with said drawing die, said junction rods being pressed by said push rods thereby moving said drawing die toward said lower die.

2. A drawing machine in accordance with claim 1, wherein said drive means simultaneously moves said plurality of push rods toward said drawing die.

3. A drawing machine in accordance with claim 1, wherein said upper die is provided to be movable toward said lower die, and said junction die is fixed to said upper die.

4. A drawing machine for successively performing first-stage drawing and second-stage drawing on a plate-type workpiece (41) supported by a lower die (40) with a first drawing die (42) and a second drawing die (43) respectively, said drawing machine comprising:

an upper die (44);

a plurality of first push rods (45, 46) held by said upper die to be movable along the pressing direction;

a plurality of second push rods (47, 48) held by said upper die to be movable along the pressing direction and paired with said first push rods respectively;

first drive means (49) for moving said plurality of first push rods toward said drawing dies;

second drive means (50) for moving said plurality of second push rods toward said drawing dies;

a junction die (55) located between said upper die and said first and second drawing dies and provided with holes in positions corresponding to respective pairs of said first and second push rods;

a first junction rod (53) movably held in a first group of said plurality of holes provided in said junction die so that its first end can be brought into contact with said first push rods and its second end can be brought into contact with said first drawing die, said first junction rod being pressed by said first push rods thereby moving said first drawing die toward said lower die; and a second junction rod (54) movably held in a second group of said plurality of holes provided in said junction die so that its first end can be brought into contact with said second push rods and its second end can be brought into contact with said second drawing die, said second junction rod being pressed by said second push rods thereby moving said second drawing die toward said lower die.

5. A drawing machine in accordance with claim 4, wherein each said second push rod has a bore longitudinally extending therethrough, and each said first push rod is slidably received in said bore of each said second push rod.

6. A drawing machine in accordance with claim 5, wherein said first junction rod has a head portion being adapted to be loosely fitted into said bore of said second push rod, so that said head portion is pressed by said first push rod.

7. A drawing machine in accordance with claim 4, wherein all of said plurality of holes provided in said junction die are identical in size to each other.

8. A drawing machine in accordance with claim 4, wherein said upper die is provided to be movable toward said lower die, and said junction die is fixed to said upper die.

9. A drawing machine in accordance with claim 4 further comprising spring means (155, 156, 157) for urging respective said junction rods to be separated from respective said drawing dies.

10. A drawing machine in accordance with claim 4, wherein said first drive means comprises a first movable plate (138) which is held by said upper die to be movable along the pressing direction and provided to be capable of simultaneously pressing said plurality of first push rods toward said junction rods, and said second drive means comprises a second movable plate (139) which is held by said upper die to be movable along the pressing direction and provided to be capable of simultaneously pressing said plurality of second push rods toward said junction rods.

11. A drawing machine in accordance with claim 10, wherein said second plate is provided under said first movable plate in an overlapping manner, and the movement stroke of said second movable plate is larger than that of said first movable plate.

12. A drawing machine in accordance with claim 11, further comprising a third movable plate (140) which is held by said upper die to be movable along the pressing direction and provided under said second movable plate in an overlapping manner, said plurality of first push rods are supported by said second movable plate, and said plurality of second push rods are supported by said third movable plate.

* * * * *

UNITED STATES PATENT AND TRADEMARK OFFICE

CERTIFICATE OF CORRECTION

PATENT NO. : 4,996,864

DATED : March 5, 1991

INVENTOR(S) : Toshiaki Enami

It is certified that error appears in the above-identified patent and that said Letters Patent is hereby corrected as shown below:

In column 11, line 13, replace "tie" by --die--.

Signed and Sealed this

Seventh Day of July, 1992

*Attest:*

DOUGLAS B. COMER

*Attesting Officer*

*Acting Commissioner of Patents and Trademarks*